US009393804B2

(12) United States Patent
Seshaiya Doraiswamy Chandrasekar

(10) Patent No.: US 9,393,804 B2
(45) Date of Patent: Jul. 19, 2016

(54) DEVICE AND METHOD FOR THE SELECTIVE CARBONIZATION OF PAPER

(71) Applicant: Tocano Holding B.V., Delft (NL)

(72) Inventor: Venkatesh Seshaiya Doraiswamy Chandrasekar, Rotterdamn (NL)

(73) Assignee: Tocano Holding B.V. (NL)

( * ) Notice: Subject to any disclaimer, the term of this patent is extended or adjusted under 35 U.S.C. 154(b) by 0 days.

(21) Appl. No.: 14/780,131

(22) PCT Filed: Mar. 25, 2014

(86) PCT No.: PCT/NL2014/050185
§ 371 (c)(1),
(2) Date: Sep. 25, 2015

(87) PCT Pub. No.: WO2014/158019
PCT Pub. Date: Oct. 2, 2014

(65) Prior Publication Data

US 2016/0052293 A1 Feb. 25, 2016

(30) Foreign Application Priority Data

Mar. 26, 2013 (NL) ..... 2010519

(51) Int. Cl.
*B41J 2/32* (2006.01)
*B41J 2/475* (2006.01)
*B41J 2/47* (2006.01)

(52) U.S. Cl.
CPC ..... *B41J 2/4753* (2013.01); *B41J 2/471* (2013.01)

(58) Field of Classification Search
CPC ..... B41F 16/00; B41F 6/0006; B41J 2/315; B41J 2/32; B41J 2/325; B41J 2/4753; B41J 2/471; G02B 26/10; G02B 26/101
USPC ..... 347/171, 178–178, 214–217, 190, 229, 347/230, 234, 236, 238, 245, 253, 261, 347/222; 283/74
See application file for complete search history.

(56) References Cited

U.S. PATENT DOCUMENTS 4,544,181 A 10/1985 Maurer et al.

FOREIGN PATENT DOCUMENTS

CN 101045410 A 10/2007
JP H04284270 A 10/1992

OTHER PUBLICATIONS

PCT International Search Report, PCT Application No. PCT/NL2014/050185, dated May 30, 2014.

*Primary Examiner* — Kristal Feggins
(74) *Attorney, Agent, or Firm* — McDonnell Boehnen Hulbert & Berghoff LLP.

(57) ABSTRACT

A device for the selective carbonization of at least a part of a surface of a paper object, including receiving means for receiving the paper object, at least one laser for selectively heating one or more parts of the surface of said paper object to a level wherein the heated part of said surface at least partly carbonizes and thereby changes color, and control means for controlling the laser.

Figure 1:
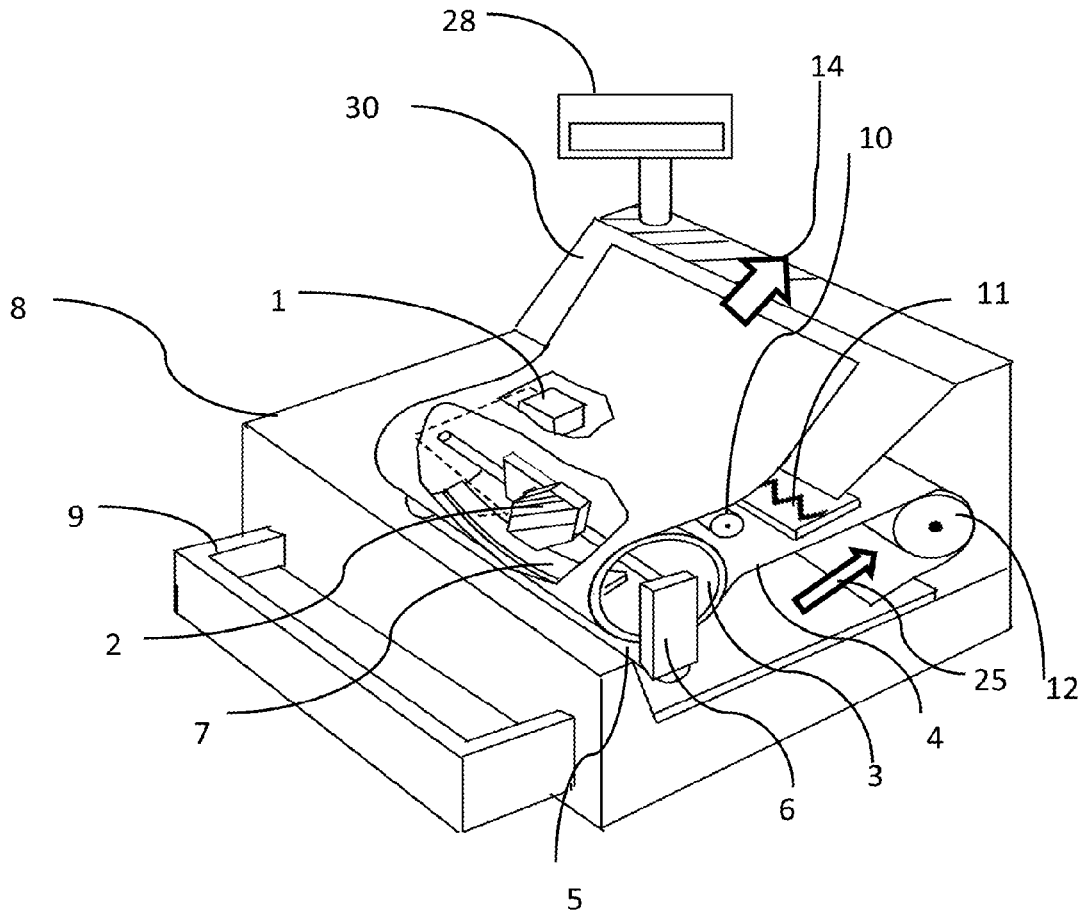

A method for the selective carbonization of at least a part of a surface of a paper object, including the steps of: receiving the object in receiving means, and controlling heating means with control means in order to selectively heat one or more parts the surface of said paper object to a level wherein the heated part of said surface at least partly carbonizes and thereby changes color.

20 Claims, 3 Drawing Sheets

DEVICE AND METHOD FOR THE SELECTIVE CARBONIZATION OF PAPER

CROSS REFERENCE TO RELATED APPLICATIONS

The present application is a national stage entry of PCT/NL2014/050185, filed 25 Mar. 2014, and claims priority to NL 2010519 filed 26 Mar. 2013. The full disclosures of NL 2010519 and PCT/NL2014/050185 are incorporated herein by reference.

The present invention relates to a device and a method for the selective carbonization of a paper object.

Conventional printers use ink in various ways to print an image on a (paper) object. Commercially available printers include toner-based printers, liquid inkjet printers, solid ink printers and dye-sublimation printers. The use of ink has several disadvantages, one of them being the limited capacity of the ink cartridges. Another disadvantage is that e.g. liquid ink might dry and clog the nozzle of a printer when the printer is not used for an extended period of time.

There have been attempts to provide inkless printers, and prior art inkless printers comprise e.g. thermal printers that work by selectively heating regions of special heat-sensitive paper. Monochrome thermal printers are used in cash registers, ATMs, gasoline dispensers and some older inexpensive fax machines.

There is a need for an inkless printer that can be used with regular paper objects, i.e. that does not require the use of special heat-sensitive paper.

An object of the present invention is to provide a printing device and printing method, that is improved relative to the prior art and wherein at least one of the above stated problems is obviated.

Such objectives as indicated above, and/or other benefits or inventive effects, are attained according to the present disclosure by the assembly of features in the appended independent device claim and in the appended independent method claim.

The present invention proposes a device for the selective carbonization of at least a part of a surface of a paper object, more particularly of a sheet of paper, comprising:

receiving means for receiving the paper object;

at least one laser for selectively heating one or more parts of the surface of said paper object to a level wherein the heated part of said surface at least partly carbonizes and thereby changes color; and control means for controlling the laser.

The carbonization reaction on the one hand produces char that acts as a black pigment on the paper object. Furthermore, organic volatiles that are also produced by the carbonization reaction are condensed on the paper object where they function as an adhesive binder for the char, and is this way creates a permanent pigment on said paper object.

The paper object preferably comprises a sheet of paper, wherein it is noted that a 'sheet op paper' may also comprise a web feeding that refers to using continuous paper feeding as used for professional book printing.

According to a preferred embodiment, said control means are configured for adjusting the power of said laser and/or selectively switching the laser on and off. These parameters control the level of carbonization of the paper object.

Although it is possible that a laser is arranged inside the roller, or alternatively, a fiber optic cable is arranged inside the roller, and use a one-axis positioning system instead of a mirror arrangement, according to a further preferred embodiment, the laser beam of said laser is reflected via a mirror towards a focus lens configured for focusing said laser beam on said paper object.

According to a preferred embodiment, the mirror is moveable, and wherein the movement of said mirror is controllable by said control means. The mirror configuration has the advantage of less moving parts and hence less mechanical wear, less inertial forces and higher printing speeds.

Preferably, said mirror is a polygon mirror, which has the further advantage that the printing speed is increased, and that it reduces the speed required to run the mirror rotating motor compared to a one face silvered mirror. The printing speed is dependent on the laser power and the mirror speed. If one face silvered mirror is used, then the speed of the motor that rotates the one-faced mirror should be four times higher than a system which uses a four-faced mirror. Hence, a polygon mirror increases the printing speed.

According to a further preferred embodiment, the focus lens comprises a combination of a F-theta lens and a telecentric lens. The (polygon) mirror scans the laser in a circular field, and therefore the carbonized spot will not be homogenous between the centre of the paper object and the width extremities of the paper object. Hence the lens mentioned in the preferred embodiment corrects this distortion by combining a F-theta lens and a telecentric lens. This configuration ensures that the power density of the laser and the spot size remain constant at all angles of the scan.

According to an even further preferred embodiment, the receiving means are configured for moving the paper object relative to the laser beam. In this way, the receiving means control which parts of the paper object are exposed to the laser beam.

According to a still further preferred embodiment, a substantially transparent cover is arranged between said laser and at least a to be heated part of said paper object. This transparent cover allows that at least the heated part of the paper object, which may be a very local area, is heated in a low oxygen environment. This low oxygen environment may be obtained in various ways, as explained below.

Preferably, the substantially transparent cover is made from glass, as this provides the further advantage that glass is low in thermal conductivity and hence will not dissipate the heat from the localized heating area on the paper object. Moreover, the glass has higher transmission efficiency for transmitting the laser.

According to a further preferred embodiment, the device comprises pressing means for pressing the substantially transparent cover on at least the to be heated part of said paper object. By pressing the substantially transparent cover on the paper object, a low oxygen environment is obtained.

Preferably, the control means are configured for adjusting the amount of pressure of the cover on the paper object. This allows the control means to control the level of oxygen at or near the to be heated part of the paper object, and in this way control the darkness and permanency of the printed char, and also control the smoke odor of the carbonization process. Moreover, the control means can control the paper object's surface roughness by applying compression on it. The reduced surface roughness will eliminate/reduce microscopic peaks and troughs on paper and will thereby allow homogenous carbonization across the surface of the paper object. The compressive force smoothens out the surface of the paper object and therefore the focus distance is more constant.

According to a further preferred embodiment, the substantially transparent cover comprises a roller, and wherein the laser beam passes in outward direction through said transparent roller where it heats said paper object that is in contact with an outer surface of said substantially transparent cover. The roller preferably also functions for through feed of said paper object.

According to a further preferred embodiment, the substantially transparent cover comprises an anti-reflective coating on the laser side of said cover. An anti-reflective coating on the laser side, i.e. inner side, of said cover reduces reflection of the laser and in this way reduces power loss or the laser.

According to a further preferred embodiment, the substantially transparent cover comprises an oleophobic coating on the paper side of said cover. An oleophopic coating lacks affinity for oils and is therefore oil repellent. By providing such an oleophobic coating on the paper side, i.e. the outer surface, of said cover, the volatiles created during the carbonization will not stick to the substantially transparent cover, but instead get transferred to the paper object where the volatiles function as an adhesive binder. The oleophobic coating also reduce degradation and wear of the substantially transparent cover, because it prevents that the volatiles condensate on the substantially transparent cover.

According to a further preferred embodiment, the paper object is sandwiched between said substantially transparent cover and a support, wherein said support preferably comprises a backing roller, and/or wherein said support even more preferably comprises reflective properties.

According to a further preferred embodiment, the paper object is sandwiched between said substantially transparent roller and a backing roller. When the rollers are pressed towards each other, a thin contact surface with a relative high pressure is obtained. This pressure reduces the amount of oxygen available at the parts that are heated by the laser. If the backing roller comprises reflective properties, the carbonization reaction is even further improved.

According to a still further preferred embodiment, the support is heated in order to maintain the paper object at a predetermined temperature. In this way, the laser beam only needs to increase the temperature from this predetermined temperature to the higher temperature where carbonization occurs. In this way, the printing speed may be increased, as the laser only has to increase the temperature of the paper over a limited amount.

According to a further preferred embodiment, the device further comprises pre-heating means configured for pre-heating at least the parts of the paper object that are to be heated with said laser. If the paper object is pre-heated at a predetermined temperature, the laser beam only needs to increase the temperature from this predetermined temperature to the higher temperature where carbonization occurs. In this way, the printing speed may be increased further, as the laser only has to increase the temperature of the paper over a limited amount.

According to a further preferred embodiment, the device further comprises an activated carbon support, and more preferably said support is an activated carbon roller. Activated carbon is a natural, environmentally safe charcoal treated with steam at an extremely high temperature in an advanced controlled process that results in producing an activated charcoal material that is literally filled with millions of micro-pockets—microscopic holes and pores inside and on the surface that make activated carbon one of the most porous materials known. Activated carbon due to these micro-pockets has the ability to absorb enormous amounts of gas particles (odors), and in this way absorbs the odors from the carbonization process.

The invention is further directed to a method for the selective carbonization of at least a part of a surface of a paper object, more particularly of a sheet of paper, comprising the steps of:

receiving the object in receiving means; and controlling heating means with control means in order to selectively heat one or more parts the surface of said paper object to a level wherein the heated part of said surface at least partly carbonizes and thereby changes color.

The carbonization reaction on the one hand produces char that acts as a black pigment on the paper object. Furthermore, organic volatiles that are also produced by the carbonization reaction are condensed on the paper object where they function as an adhesive binder for the char, and is this way creates a permanent pigment on said paper object.

According to a preferred embodiment, wherein the step of heating the surface comprises the step of radiative heating by a laser.

According to a further preferred embodiment, said laser emits light with a wavelength that substantially matches the peak absorption spectrum of said object in the near infrared range. The 'near infrared range' (NIR) is infrared with a wavelength from about 800 nm to 2500 nm. Paper object absorption peaks (due to cellulose), in the near infrared range is 17% at 1490 nm and 40% at 2100 nm. The absorption is higher in mid infra red range (e.g. 80% at 3100 nm and far infrared range but these lasers are relatively more complex and therefore more vulnerable. Hence a compromise in the near infrared range is preferred. As reliability and cost price of mid infrared range lasers increases over time, they may become preferred lasers.

According to a further preferred embodiment, said method comprises the step of the control means adjusting the power of said laser and/or selectively switching the laser on and off in order to selectively expose the paper object to the laser.

According to a further preferred embodiment, the control means control the movement of said laser beam in order to selectively expose the paper object to the laser beam.

According to a further preferred embodiment, said method comprises the step of the receiving means moving the paper object relative to the laser.

According to an even further preferred embodiment, the heated part of the paper object is heated in a low oxygen environment. This may be a very local low oxygen environment that is only temporary obtained at or near the point where the laser beam hits and heats the paper object.

According to a preferred embodiment, said low oxygen environment is created by one or more of the following steps:

creating a partial vacuum by pumping air away from at least the to be heated part of said paper object;

introducing an inert gas at or near at least the to be heated part of said paper object;

introducing steam at or near at least the to be heated part of said the paper object;

isolating at least the to be heated part of said paper object from the surrounding atmosphere by using a thermally conductive barrier; and/or isolating at least the to be heated part of said paper object from the surrounding atmosphere by using a substantially transparent cover.

According to a further preferred embodiment of the method, the low oxygen environment is created by placing a substantially transparent cover on top of said paper object and wherein said laser heats said paper object through said substantially transparent cover, wherein said transparent cover is preferably pressed on at least the to be heated parts of said paper object.

According to an even further preferred embodiment of the method, the control means control the carbonization by one or more of the following steps:

adjusting the power of the laser;

adjusting the exposure time of laser per unit area of the paper object;

adjusting the rate compression at the to be heated parts of said paper object; and/or adjusting the focus of the laser beam.

According to a further preferred embodiment of the method, a device according as describe above is used.

Figure 2:
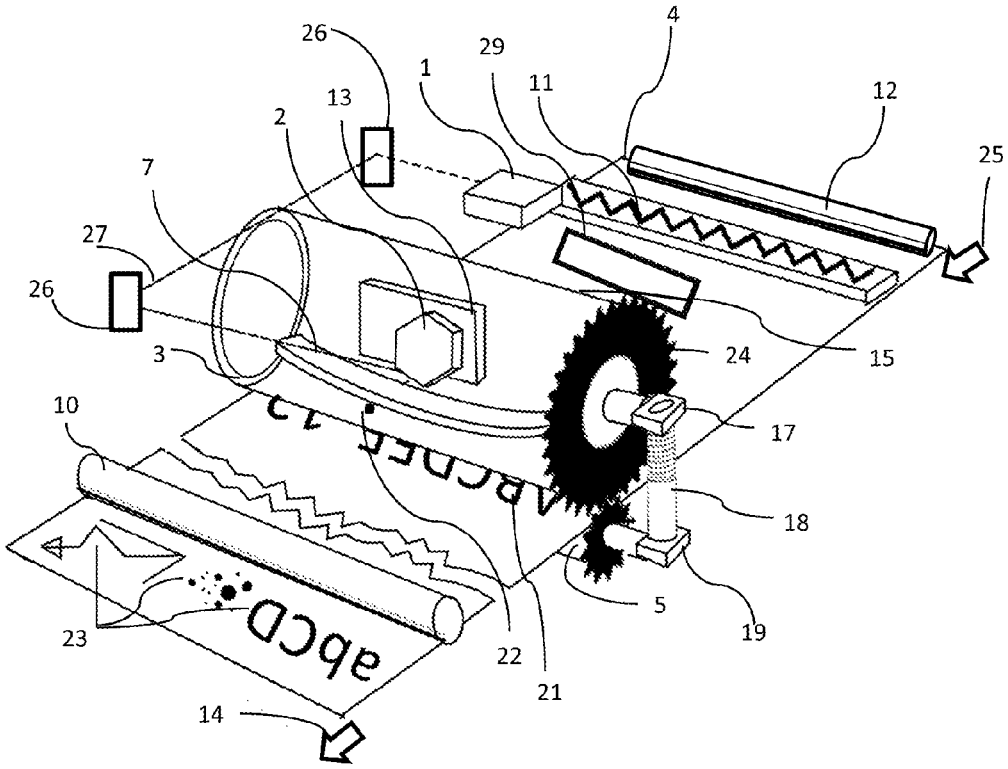
Figure 3:
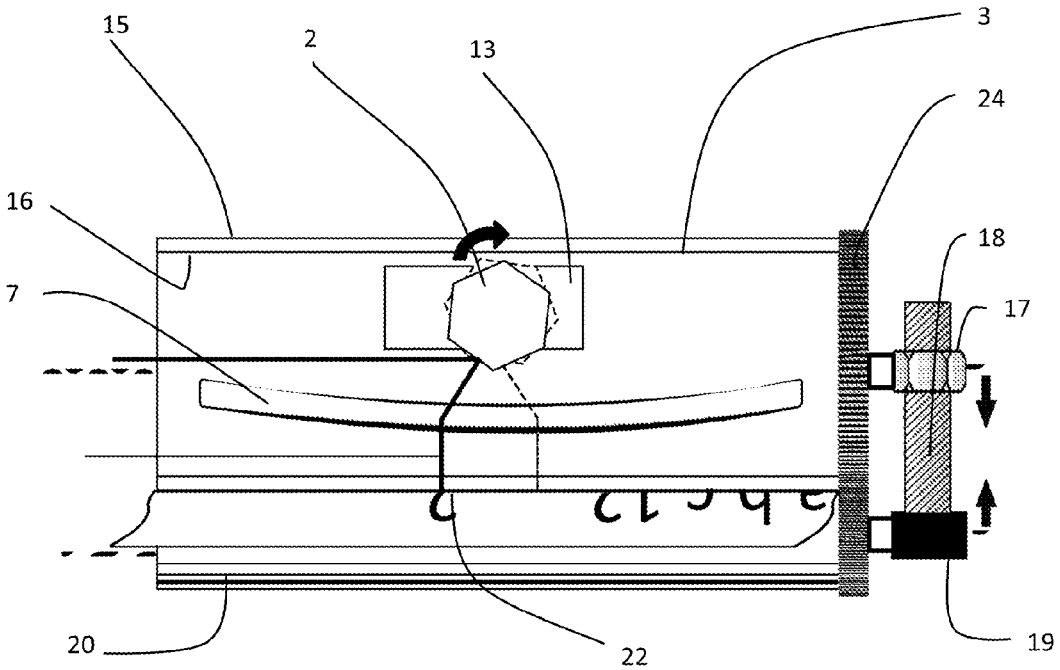

In the following description preferred embodiments of the present invention are further elucidated with reference to the drawing, in which:

FIG. 1: is a perspective view of an inkfree desktop printer with the casing partially cutaway according to a first preferred embodiment;

FIG. 2: is a detailed perspective view of the inkfree printer of FIG. 1, wherein the paper flow path is simplified and shown as a flat plane;

FIG. 3: shows a close-up of the carbonizing area; and

Figure 4:
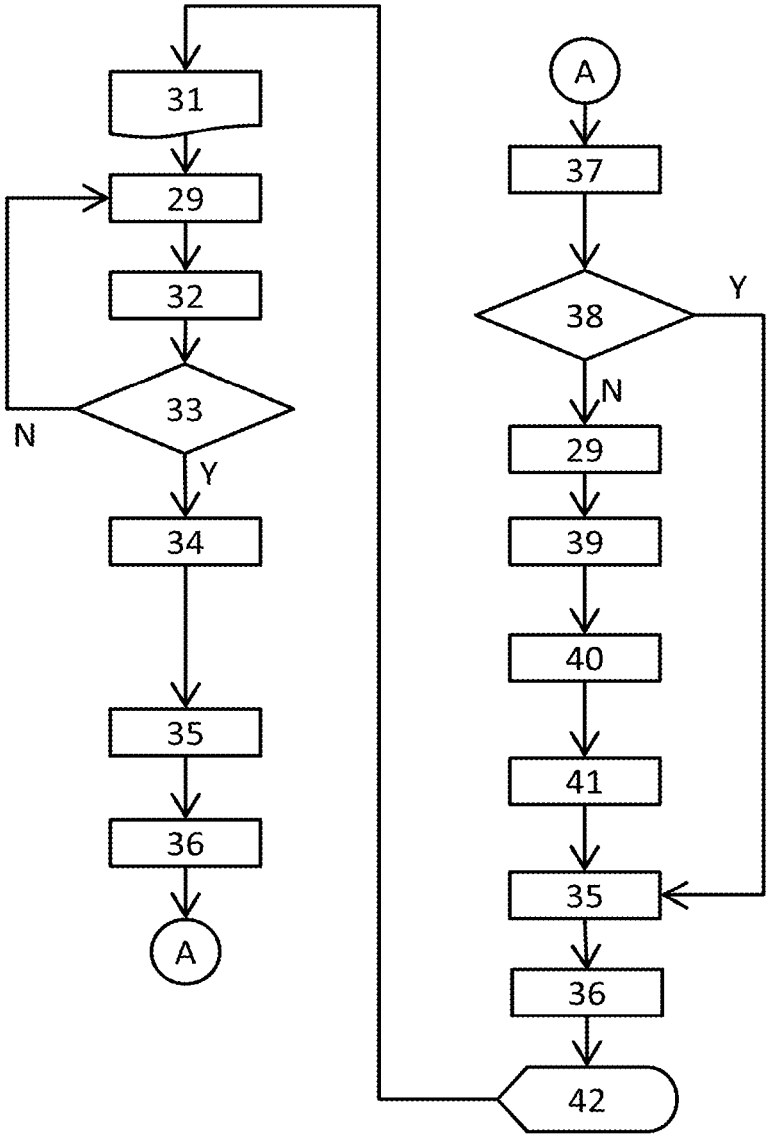

FIG. 4: is a flow diagram schematically illustrating the process sequence of the printer control unit.

The preferred embodiment in FIG. 1 shows a table top inkfree printer which comprises a casing 8, a paper tray 9 which allows a user to load the printer with a stack of individual paper objects 4, and a touch screen 28 for user interaction. Furthermore it comprises a receiving means for receiving the paper object 4 from paper tray 9, using feeding rollers 12 to feed individual paper sheets in the direction illustrated by arrow 25.

Selective heating of the surface of said paper object 4, to a level wherein the heated part of said surface at least partly carbonizes and thereby changes color, is achieved by striking the paper with a laser beam using laser diode 1. In the shown embodiment the laser emits light with a wavelength of 1490 nm, but the skilled person will understand that the invention is also applicable with lasers that function at other wavelengths. Preferably, the power of the laser is dynamically adjusted by the printer control unit 29 to reach at least sufficient darkness by carbonization.

In order to illustrate the carbonization process, FIG. 2 shows a simplified view wherein the paper flow path is flattened. Laser beam 27 strikes the paper object 4 in a low oxygen environment. In the shown embodiment, the low oxygen environment is created by placing a hollow glass roller 3, just touching the paper object 4. Laser 27 heats said paper object 4 through said hollow glass roller 3 wherein said hollow glass roller 3 is pressed on the paper object 4 at the heating area 22 where it's heated by the laser beam 27.

The skilled person will understand that a low oxygen environment may be obtained in other ways, e.g. via one or more of the following options:

creating a partial vacuum by pumping air away from at least the to be heated part of said paper object;

introducing an inert gas at or near at least the to be heated part of said paper object;

introducing steam at or near at least the to be heated part of said the paper object; and/or isolating at least the to be heated part of said paper object from the surrounding atmosphere by using a thermally conductive barrier.

These other options may also be combined with the solution of the shown embodiment, wherein at least the to be heated part of said paper object 4 is isolated from the surrounding atmosphere by using a substantially transparent cover, i.e. glass roller 3.

Paper object 4 is fed in between hollow glass roller 3 and a backing roller 5. The backing roller 5 is a hard rubber roller that takes up compressive forces and preferably comprises a reflective coating 20 to enhance the laser absorption efficiency of the paper object 4.

Laser beam 27 emitted by laser diode 1 is directed using laser path directing mirrors 26 such that it falls on a polygonal mirror 2. In the shown embodiment the polygonal mirror is a hexagonal mirror 2 that is rotatable by a motor driver unit 13. The rotational speed at which the motor driver unit 13 rotates the hexagonal mirror 2 is dependent on the linear speed of paper object 4, which in turn ensures that the printer speed is at market competitive 40 pages per minute. Movement of the polygonal mirror 2 is preferably controlled via the printer control unit 29. By rotating, the hexagonal mirror 2 reflects the laser beam 27 such that it sweeps the surface of the paper object 4 through the hollow glass roller 3.

When the laser beam 27 heats and carbonizes the surface of the paper object 4 through the hollow glass roller 3, the volatiles created during the carbonization will tend to condense on the glass surface of said roller 3 and overtime they will degrade and wear the hollow glass roller 3. In order to ensure that the volatiles don't stick on the hollow glass roller 3 but instead get transferred to the paper as an adhesive binder, the hollow glass roller 3 is preferably coated with an oleophobic coating 5 on the side of the roller 3 facing the paper object 4. Moreover, to reduce losses of laser radiation due to reflection, the laser side of the hollow glass roller 3 preferably is provided with an anti-reflective coating 16.

Hollow glass roller 3 comprises a lens system 7 that preferably comprises both an F-theta lens and a telecentric lens (FIG. 3). The F-theta lens creates a flat field for the laser, while the telecentric lens provides the advantage that the laser beam travels the same distance from the polygon mirror across all the points of the scan line. A telecentric lens provides that an object will have the same size irrespective of the distance from the lens. Hence the spot size and the power density remain constant at all angles of scan. This make the focus point of the laser beam 27 to always lie on the paper object 4 at the region where the paper object 4 is sandwiched between the hollow glass roller 3 and backing roller 5, irrespective of the scan angle.

In order to feed the paper and compress the paper object 4 at the same time, the backing roller 5 and the hollow glass roller 3 are preferably coupled in two ways (FIG. 3). Firstly, backing roller 5 and hollow glass roller 3 are meshed by feed gears 24 to ensure that they both run at a constant rotational speed to prevent the paper object 4 from slipping, which would result in distorted/unexpected carbonization. Secondly, backing roller 5 and hollow glass roller 3 are coupled together by a stepper motor 19 which drives a lead screw 18 and nut 17 arrangement (FIG. 3). When the stepper motor 19 is activated, it rotates lead screw 18 and moves lead screw nut 17, and thereby increases or decreases the level of compression between the hollow glass roller 3 and the backing roller 5. The compressive force between the aforesaid two rollers 3,5 and the synchronization of the speed of these two rollers 3,5, as well as the rotational speed of hexagonal mirror is controlled by the printer control unit 29.

Preferably, the printer also comprises a thin film heater 11 that is based on resistive heating and is configured to raise the temperature of paper object 4 up to a temperature below its carbonization temperature (200-250° C.) (FIG. 2). This preheating occurs before the paper object 4 is selectively carbonized by laser radiation. The preheating is also controlled by the printer control unit 29.

Once the paper object 4 is carbonized with desired text/images, it preferably passes an activated carbon roller 10 to de-odorize the volatiles produced due to carbonization reaction.

Printer control unit 29 forms the control means of the inkfree printer, and FIG. 4 describes the logical sequence of steps performed by the printer control unit 29. When information is sent to the inkfree printer in the form of a desired text/image from a computing device or storage device or from the cloud, the following process steps take place in order to print the desired text/image and they are controlled and synchronized by the printer control circuit 29.

The text/image document to be printed is initially sent by a user or by another computing device to the inkfree printer (process step 31). The printer control unit 29 stores the document in its local memory, checks for errors and rasterizes the document (i.e. converts the desired image into thousands of dots). Next, as per process step 32, for first time printing, the pre-heater 11 is turned 'on' by printer control unit 29 and it warms up to reach 200° C. Once the temperature reaches 200° C. (decision block 33), information is sent to the printer control unit 29 and the pre-heater 11 maintains the temperature substantially constant. Next, in process step 34, the paper object 4 is fed by the paper feed rollers 12 to the pre-heating system 11. Once the pre-heater 11 heats the paper object 4 to about 200° C., the hexagonal scanning mirror 2 begins to rotate at a scanning frequency corresponding to a 40 pages per minute printing speed (process step 35). Corresponding to the scanning frequency and the raster data, the laser diode 1 receives a switching pulse from printer control unit 29 and it turns the laser diode 1 on/off to selectively carbonize the paper object 4 (process step 36). As per step 37, the first few (e.g. ten) dots made on the paper are measured automatically using a imaging sensor and a decision is taken (in process step 38) by the printer control unit 29 and, preferably, if it is not darker than 90% black, the printer control unit 29 will change other parameters such as laser power (process step 39), time per spot of carbonization (process 40) and the compression pressure (process 41) such that the desired darkness, spot size and depth of carbonization are achieved. In the final process step 42, the desired image/text 23 is carbonized on the paper object and the carbonized paper 23 is collected in the output tray 30. Now the printer is ready for the next document or duplexing.

Although they show preferred embodiments of the invention, the above described embodiments are intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. Furthermore, it is particularly noted that the skilled person can combine technical measures of the different embodiments. The scope of the invention is therefore defined solely by the following claims.

The invention claimed is:

1. Printing device for the selective carbonization of at least a part of a surface of a paper object, comprising:

receiving means for receiving the paper object;

at least one laser for selectively heating one or more parts of the surface of said paper object to a level wherein the heated part of said surface at least partly carbonizes and thereby changes color; and a controller for controlling the laser;

characterized in that said printing device comprises a substantially transparent cover that is arranged between said laser and at least a to be heated part of said paper object.

2. Printing device according to claim 1, wherein a laser beam of said laser is reflected via a mirror towards a focus lens configured for focusing said laser beam on said paper object.

3. Printing device according to claim 2, wherein the mirror is moveable, and wherein the movement of said mirror is controllable by said control means.

4. Printing device according to claim 2, comprising pressing means for pressing the substantially transparent cover on at least the to be heated part of said paper object, wherein said transparent cover defines a pressing element.

5. Printing device according to claim 2, wherein the substantially transparent cover comprises an anti-reflective coating on the laser side of said cover.

6. Printing device according to claim 2, wherein the paper object is sandwiched between said substantially transparent cover and a support, wherein said support comprises a backing roller, and/or wherein said support comprises reflective properties.

7. Printing device according to claim 1, wherein the substantially transparent cover comprises an anti-reflective coating on the laser side of said cover.

8. Printing device according to claim 1, wherein the substantially transparent cover comprises an oleophobic coating on the paper side of said cover.

9. Printing device according to claim 1, wherein the paper object is sandwiched between said substantially transparent cover and a support, wherein said support comprises a backing roller, and/or wherein said support comprises reflective properties.

10. Printing device according to claim 1, comprising preheating means configured for pre-heating at least the parts of the paper object that are to be heated with said laser.

11. Printing device according to claim 1, comprising an activated carbon support, wherein said support is an activated carbon roller.

12. Printing device for the selective carbonization of at least a part of a surface of a paper object, comprising:

receiving means for receiving the paper object;

at least one laser for selectively heating one or more parts of the surface of said paper object to a level wherein the heated part of said surface at least partly carbonizes and thereby changes color; and a controller for controlling the laser;

characterized in that said printing device comprises a pressing element positioned above said paper object, where the pressing element is adapted to press downwardly onto said paper object.

13. Printing device according to claim 12, wherein the pressing element comprises a roller.

14. Method for the selective carbonization of at least a part of a surface of a paper object, comprising the steps of:

receiving the object in receiving means positioned in a printing device;

controlling heating means with control means in order to selectively heat one or more parts the surface of said paper object to a level wherein the heated part of said surface at least partly carbonizes and thereby changes color;

wherein the step of heating the surface comprises the step of radiative heating by a laser;

wherein the heated part of the paper object is heated in a low oxygen environment; and wherein the low oxygen environment is created by placing a substantially transparent cover of the printing device on top of said paper object and wherein said laser heats said paper object through said substantially transparent cover, wherein said transparent cover is pressed on at least the to be heated parts of said paper object.

15. Method according to claim 14, wherein said laser emits light with a wavelength that substantially matches the peak absorption spectrum of said object in the near infrared range.

16. Method according to claim 15, wherein the low oxygen environment is created by isolating at least the to be heated part of said paper object from the surrounding atmosphere by using a substantially transparent cover.

17. Method according to claim 14, wherein the low oxygen environment is created by one or more of the following steps:

creating a partial vacuum by pumping air away from at least the to be heated part of said paper object;

introducing an inert gas at or near at least the to be heated part of said paper object;

introducing steam at or near at least the to be heated part of said the paper object; and isolating at least the to be heated part of said paper object from the surrounding atmosphere by using a thermally conductive barrier; and/or isolating at least the to be heated part of said paper object from the surrounding atmosphere by using a substantially transparent cover.

18. Method according to claim 14, wherein the low oxygen environment is created by isolating at least the to be heated part of said paper object from the surrounding atmosphere by using a substantially transparent cover.

19. Method according to claim 14, wherein the control means control the carbonization by adjusting the rate compression at the to be heated parts of said paper object.

20. Method according to claim 14, wherein the low oxygen environment is created by one or more of the following steps:

creating a partial vacuum by pumping air away from at least the to be heated part of said paper object;

introducing an inert gas at or near at least the to be heated part of said paper object;

introducing steam at or near at least the to be heated part of said the paper object; and isolating at least the to be heated part of said paper object from the surrounding atmosphere by using a thermally conductive barrier.

* * * * *